US005857671A

United States Patent [19]

Kato et al.

[11] Patent Number: 5,857,671

[45] Date of Patent: Jan. 12, 1999

[54] SHEET FEEDER HAVING IMPROVED SHEET SEPARATION REGARDLESS OF RIGIDITY AND SIZE OF SHEET

[75] Inventors: Hiroyuki Kato; Takatoshi Takemoto, both of Nagoya, Japan

[73] Assignee: Brother Kogyo Kabushiki Kaisha, Nagoya, Japan

[21] Appl. No.: 773,033

[22] Filed: Dec. 24, 1996

[30] Foreign Application Priority Data

Dec. 26, 1995 [JP] Japan ..... 7-351794
Mar. 29, 1996 [JP] Japan ..... 8-077049

[51] Int. Cl.[6] ..... B65H 5/00

[52] U.S. Cl. ..... 271/10.11; 271/119; 271/121; 271/127; 271/171

[58] Field of Search ..... 271/171, 10.11, 271/10.12, 119, 121, 124, 127, 149, 21

[56] References Cited

U.S. PATENT DOCUMENTS

| | | | |
|---|---|---|---|
| 3,713,645 | 1/1973 | Ferrari et al. . | |
| 3,727,910 | 4/1973 | Vora . | |
| 4,372,547 | 2/1983 | Yanagawa et al. . | |
| 4,995,601 | 2/1991 | Ohashi et al. | 271/171 |
| 5,026,042 | 6/1991 | Miller . | |
| 5,044,622 | 9/1991 | Cattin . | |
| 5,172,903 | 12/1992 | Hareda et al. | 271/171 |
| 5,232,214 | 8/1993 | Matsuura et al. | 271/121 |
| 5,372,359 | 12/1994 | Miura et al. | 271/119 |
| 5,527,029 | 6/1996 | Bortolotti et al. . | |
| 5,620,174 | 4/1997 | Taniguro et al. | 271/10.12 |
| 5,711,519 | 1/1998 | Bortolotti | 271/119 |

FOREIGN PATENT DOCUMENTS

| | | |
|---|---|---|
| 0 386 737 A | 9/1990 | European Pat. Off. . |
| 0 528 434 A | 2/1993 | European Pat. Off. . |
| 0 672 601 A | 9/1995 | European Pat. Off. . |
| 2 445 284 A | 7/1980 | France . |
| 22 65 108 A | 4/1976 | Germany . |
| A-2-132018 | 5/1990 | Japan . |
| A-7-247033 | 9/1995 | Japan . |
| 1 391 198 | 4/1975 | United Kingdom . |
| 2 187 716 | 9/1987 | United Kingdom . |
| WO 89/03798 | 5/1989 | WIPO . |

*Primary Examiner*—H. Grant Skaggs
*Attorney, Agent, or Firm*—Oliff & Berridge, PLC

[57] ABSTRACT

A sheet feeder capable of providing accurate separation of an uppermost sheet from remaining sheets of a sheet stack stored in a hopper regardless of a size and rigidity of the sheets. The sheet feeder includes a sheet feed roller positioned in confrontation with the hopper for feeding the sheet in a sheet feeding direction. An outlet end portion of the hopper is provided with a wall to which the leading edge of the sheet abuts. The wall is provided with a slanted surface sloping toward the sheet feeding direction, and a stop member protrudable from or retractable into the slanted surface. The stop member is biased in the protruding direction by a coil spring. When the sheets having high rigidity are stored in the hopper, the leading edge of the sheet pushes the stop member into the slanted surface (51) and the uppermost sheet is separated from the remaining sheets by the slanted surface. When the sheets having low rigidity are stored, the leading edge of the sheet abuts against the protruding stop member for imparting large bending of the sheet.

20 Claims, 12 Drawing Sheets

SHEET FEEDER HAVING IMPROVED SHEET SEPARATION REGARDLESS OF RIGIDITY AND SIZE OF SHEET

BACKGROUND OF THE INVENTION

The present invention relates to a sheet feeder having a sheet hopper and a sheet feed roller for delivering each one of the sheets stacked in the hopper to a predetermined location.

In a known sheet feeder used in a printer, the sheet in the uppermost position of a sheet stack in a sheet hopper is delivered in the specified feed direction by a sheet feed roller which is in contact with the uppermost sheet. A slanted surface is connected to the hopper, so that a leading edge of the delivered uppermost sheet hits the slanted surface. Therefore, the uppermost sheet is flexed or bent, so that the uppermost sheet can be separated from the subsequent sheet of the sheet stack, and can be delivered to a specified position such as a printing position outside the hopper. This conventional arrangement is disclosed in, for example, Japanese Laid-Open Patent Application KokaiNo. Hei 2-132018 corresponding to a U.S. Pat. No. 5,026,042.

According to the disclosed conventional device, the separability of the sheet from the remaining sheet stack and a type or kind of sheets that can be used are limited by the properties of the slanted surface, such as its slope and coefficient of friction. For instance, since a sheet having a low rigidity is difficult to separate, the slope of the slanted surface must be increased to provide sufficient flexion to the flexible sheet. However, if a sheet having high rigidity such as a postcard or an envelope, hits the large sloped slanted surface, there is the danger that excessively large resistance may be imparted upon the rigid sheet, and slipping rotation may occur in the sheet feed roller.

In order to avoid this drawback, a stop member may be provided at the slanted surface in an attempt to improve separation efficiency of the sheet having low rigidity. However, since the sheet feeder must install sheets of various width, it would be rather difficult to determine the position of the stop member. If the position of the stop member is improper, the stop member may produce a local resistance against the delivery of the sheet, which causes diagonal feeding of the sheet.

SUMMARY OF THE INVENTION

It is therefore, an object of the present invention to provide an improved sheet feeder capable of separating one sheet from the remaining sheets with high reliability regardless of the rigidity or size of the sheet.

Another object of the present invention is to provide such sheet feeder having an optimum position of a stop member relative to the slanting surface.

These and other objects of the present invention will be attained by a sheet feeder for feeding each one of cut sheets in a sheet feeding direction including a hopper, at least one sheet feed roller, a stop member and a biasing member. The hopper houses therein a stack of sheets, and the hopper has a wall portion at a position in confrontation with each leading edge of the sheets when the stack of sheets are housed in the hopper. The at least one sheet feed roller is disposed in contact with an uppermost sheet of the sheet stack for feeding the uppermost sheet in the sheet feeding direction. The wall portion includes a sheet receiving surface in contact with each leading edge of the sheets, and a slanted surface positioned downstream of the sheet receiving surface in the sheet feeding direction. The stop member is movable between a protruding position protruding out of the slanted surface and a retracted position retracting into the slanted surface. The stop member has a contact surface in contact with a sheet. A maximum angle defined between the contacting surface and the sheet in the hopper is 90 degrees when the stop member is in the protruding position. The biasing member is connected to the stop member for urging the stop member to its protruding position.

In another aspect of the invention, there is provided a sheet feeder for feeding each one of cut sheets in a sheet feeding direction comprising a hopper, at least one sheet feed roller, a stop member and a biasing member. The hopper houses therein a stack of sheets and defines a widthwise center line. The hopper has a wall portion at a position in confrontation with each leading edge of the sheets when the stack of sheets are housed in the hopper. The at least one sheet feed roller is disposed in contact with an uppermost sheet of the sheet stack for feeding the uppermost sheet in the sheet feeding direction. The wall portion includes a sheet receiving surface in contact with each leading edge of the sheets, and a slanted surface positioned downstream of the sheet receiving surface in the sheet feeding direction. The stop member is movable between a protruding position protruding out of the slanted surface and a retracted position retracting into the slanted surface. The stop member is positioned symmetrically with respect to the widthwise center line. The biasing member is connected to the stop member for urging the stop member to its protruding position.

In still another aspect of the invention, there is provided a sheet feeder for feeding each one of cut sheets in a sheet feeding direction including a hopper, first and second sheet feed rollers, the above described stop member and the above described biasing member. The hopper houses therein a stack of sheets and has the above described wall portion at a position in confrontation with each leading edge of the sheets when the stack of sheets are housed in the hopper. The first and second sheet feed rollers are disposed in contact with an uppermost sheet of the sheet stack for feeding the uppermost sheet in the sheet feeding direction. The first sheet feed roller provides a first sheet feed force directing in the sheet feeding direction, and a second sheet feed roller provides a second sheet feed force directing in the sheet feeding direction. The first and second sheet feed forces provide a resultant force directing in the sheet feeding direction at a line of action. The stop member is positioned symmetrically with respect to the line of action in the widthwise direction of the sheet.

In still another aspect of the invention, there is provided a sheet feeder for feeding each one of cut sheets in a sheet feeding direction including a hopper, a plurality of sheet feed rollers, and the above described stop member. The hopper houses therein a stack of sheets and has the above described wall portion. The hopper also has at least one sheet guide positioning one lateral edge of the sheet at a predetermined position regardless of a width of the sheet. The plurality of sheet feed rollers are disposed in contact with an uppermost sheet of the sheet stack for feeding the uppermost sheet in the sheet feeding direction. The plurality of sheet feed rollers are spacedly and coaxially arrayed in a widthwise direction of the sheet and includes a closest sheet feed roller positioned closest to the at least one sheet guide and a farthest sheet feed roller positioned farthest from the at least one sheet guide among the plurality of sheet feed rollers. The wall portion includes a sheet receiving surface in contact with each leading edge of the sheets, and a slanted surface positioned downstream of the sheet receiving surface in the sheet feeding direction. The slanted surface is slanted toward the stack of sheet in the hopper. A first distance between the stop member and the at least one sheet guide is greater than a second distance between the closest sheet feed roller and the at least one sheet guide, and the first distance is smaller than a third distance between the farthest sheet feed roller and the at least one sheet guide.

BRIEF DESCRIPTION OF THE DRAWINGS

In the drawings;

FIG. 5(*b*) shows a state in which the leading edge of the sheet having the low rigidity is slidingly moved along a surface of the stop member;

FIG. 5(*c*) shows a state in which the leading edge has been moved past the stop member;

DETAILED DESCRIPTION OF THE PREFERRED EMBODIMENTS

A sheet feeder and a printing device having the sheet feeder according to a first embodiment of the present invention will be described with reference to FIGS. 1 through 6 in which the present invention is applied to an ink jet printer.

Figure 1:
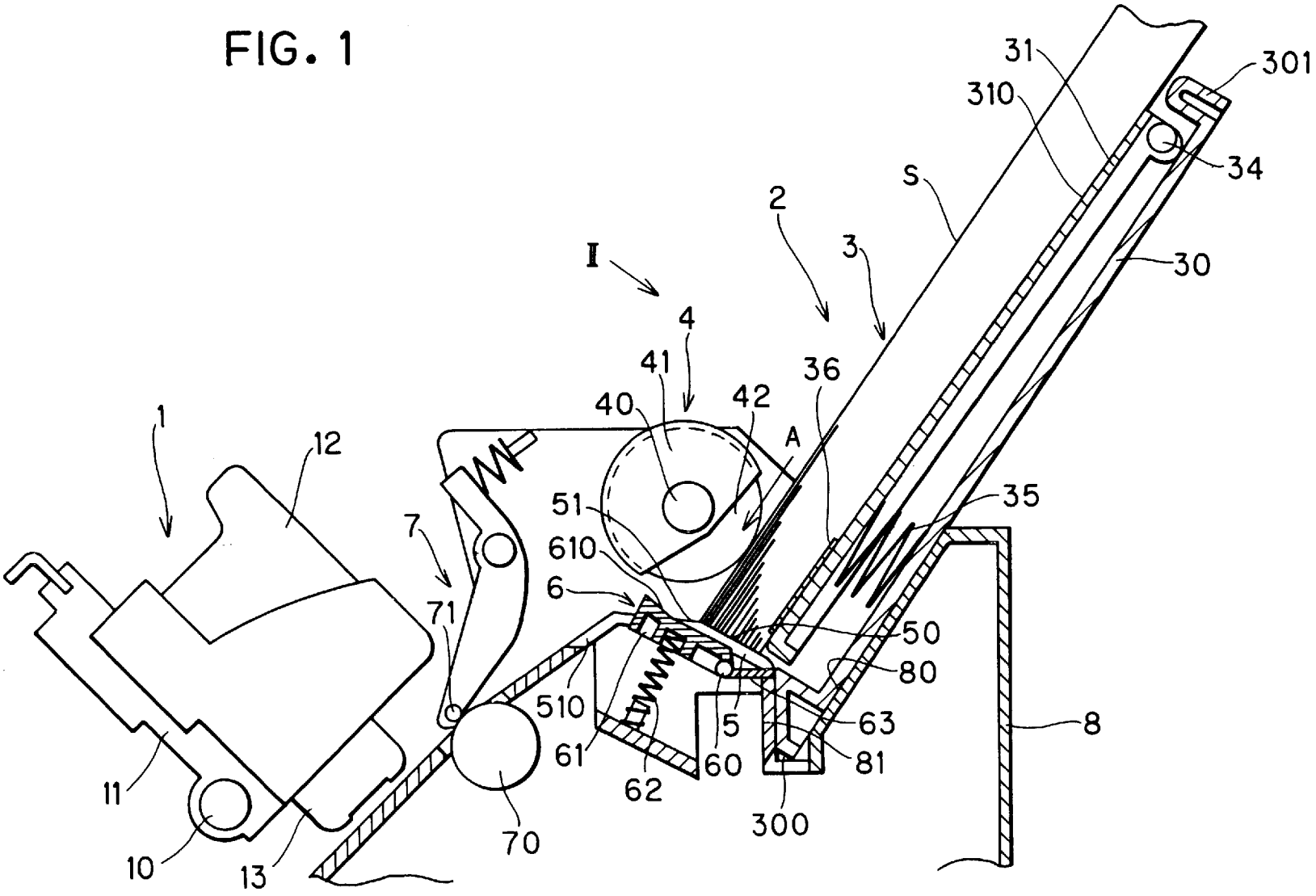
FIG. 1 is a vertical cross-sectional view showing an essential portion including a sheet feeder and bridging from a hopper to a printing mechanism in an ink jet printer according to a first embodiment of the present invention.

In FIG. 1, the ink jet printer includes a printing mechanism 1 which performs printing on a sheet S, and a sheet feeder 2 which supplies each one of sheets S to the printing mechanism 1. The sheet S is so-called a cut sheet that has been cut to a rectangular shape of specific dimensions.

The printing mechanism 1 is provided with a main frame 8, a carriage 11 that moves back and forth along a guide rail 10, and an ink cartridge 12 and a printing head 13 those supported by the carriage 11. The guide rail 10 extends in a widthwise direction of the sheet S supplied from the sheet feeder 2, that is, in the direction perpendicular to the feeding direction of the sheet S as shown by an arrow A in FIG. 1. The guide rail 10 also extends in parallel to the surface of the sheet S.

During printing, while the carriage 11 is moved back and forth by a drive source such as an electric motor (not shown), ink droplets are ejected from the printing head 13 toward the sheet S passing underneath the printing head 13. Thus, an inked image is formed on the sheet S. Incidentally, the sheet feed direction can be varied as needed according to the layout of the sheet feeding passage. However, in FIG. 1, the sheet feeding direction is represented by the direction in which the sheet S is fed from the hopper 3.

The sheet feeder 2 has a hopper 3 for storing a stack of the sheets S, a feed mechanism 4 for feeding the sheet S from the hopper 3, a wall 5 to which a leading edge of the sheet S fed from the hopper 3 will abut, a stop mechanism 6 provided to the wall 5, and a conveyor mechanism 7 positioned downstream of the wall 5 in the sheet feeding direction for conveying the sheet S to directly beneath the printing head 13.

The hopper 3 is provided with a sheet feed cassette 30 provided detachably from the main frame 8 of the printer. More specifically, the main frame 8 includes a cassette receiving surfaces 80, 81, and the sheet feed cassette 30 is supported in an inclined state with the front end 300 side thereof (the discharge end side of the sheet S) facing down and abutting the cassette receiving surfaces 80 and 81.

Figure 2:
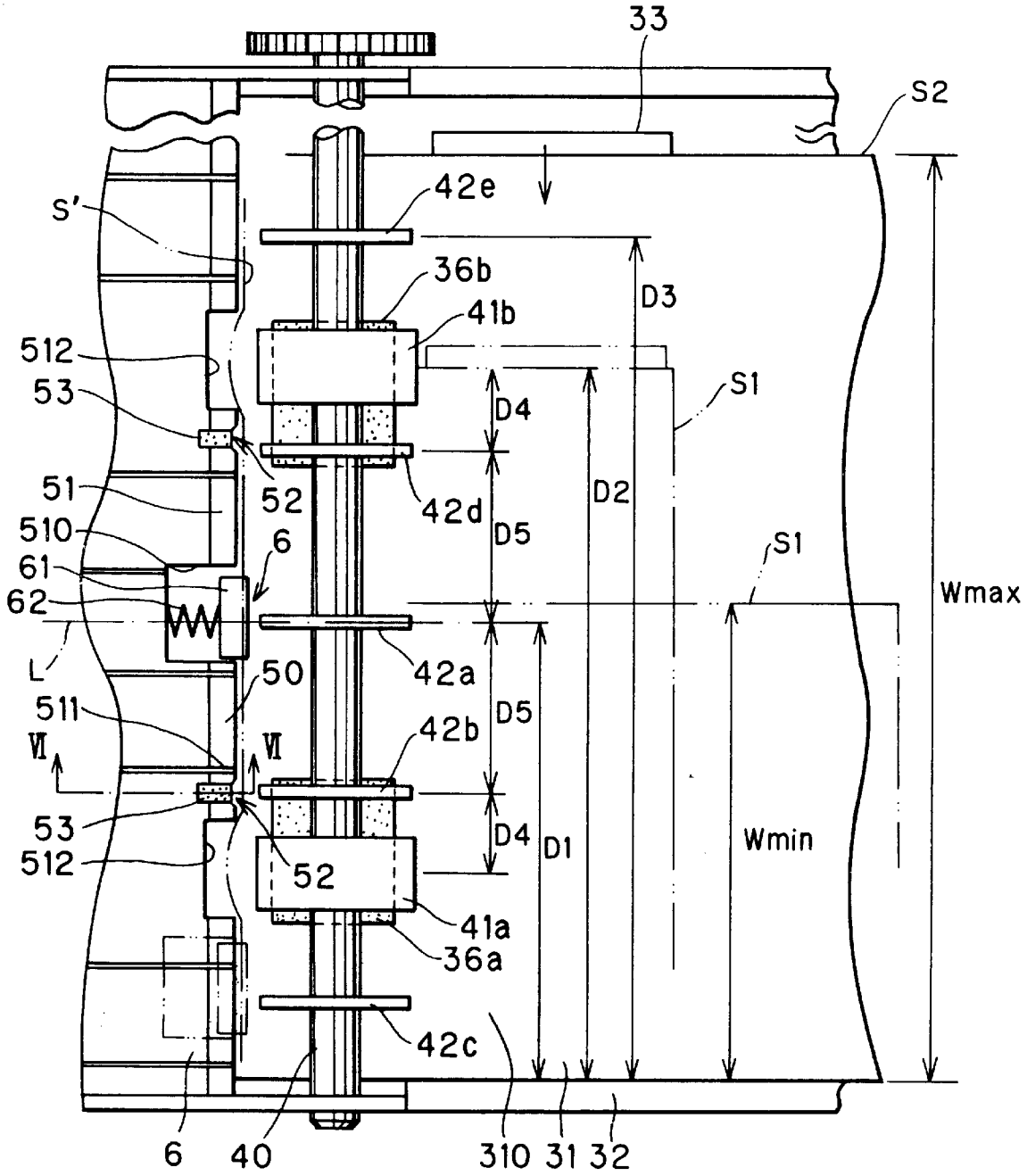
FIG. 2 is a plan view as viewed from a direction of an arrow II in FIG. 1.

The inside of the sheet cassette 30 is provided with a lifter plate 31, and the sheet S is stacked on an upper surface 310 of the lifter plate 31. As shown in FIG. 2, a pair of first and second sheet guides 32 and 33 are provided for interposing the sheets S therebetween in a widthwise direction of the sheets. The sheet guides 32,33 are provided to the sides of the lifter plate 31. The first sheet guide 32 is fixed to the lifter plate 31, while the second sheet guide 33 is movable in the lateral direction of the sheet S.

Positioning of the sheet S on the lifter plate 31 can be made by abutting one lateral side of the sheet against the first sheet guide 32, and then, the second sheet guide 33 is moved until the second sheet guide 33 abuts another lateral side of the sheet S. Therefore, regardless of the width of the sheet S, the sheet S housed in the hopper 3 is supported so that the one lateral side that abuts against the first sheet guide 32 is in a nearly constant position.

As shown in FIG. 1, the lifter plate 31 is rotatably provided about a pivot shaft 34 provided to a rear end 301 side of the sheet feed cassette 30. A spring 35 is provided for urging the lifter plate 31 toward the feed mechanism 4 for lifting up the leading edge of the sheet S. The pivot shaft 34 extends in parallel to the lateral direction of the sheet S. The lifter plate 31 is molded from a resin, and a coefficient of friction of the upper surface 310 of the lifter plate 31 is relatively low. Therefore, the frictional resistance between the upper surface 310 of the lifter plate 31 and the lowermost sheet S in the hopper 3 is less than the frictional resistance between the stacked neighboring sheets S. As a result, if only a few sheets such as two or three sheets remain in the sheet cassette 30, there is the possibility that all of the sheets S will slide over the upper surface 310 of the lifter plate 31 and will be fed all at once. To avoid this drawback, a friction member 36 is attached to the upper surface 310 of the lifter plate 31, so that the lowermost sheet S in the hopper 3 can be retained on the lifter plate 31. The friction member 36 may be formed of a cork.

As shown in FIGS. 1 and 2, the feed mechanism 4 includes a support shaft 40 extending in parallel to the lateral direction of the sheet S, a pair of sheet feed rollers 41*a,* 41*b* mounted on the support shaft 40, and five collars 42*a,* 42*b,* 42*c,* 42*d,* and 42*e*. The sheet feed rollers 41*a,* 41*b* are positioned spaced away from each other in an axial direction of the support shaft 40. Incidentally, when there is no need to distinguish between the two sheet feed rollers 41*a* and 41*b,* they will be simply referred to as the sheet feed roller 41, and when there is no need to distinguish among the various collars 42*a* through 42*e,* they will be simply referred to as the collar 42.

Figure 3:
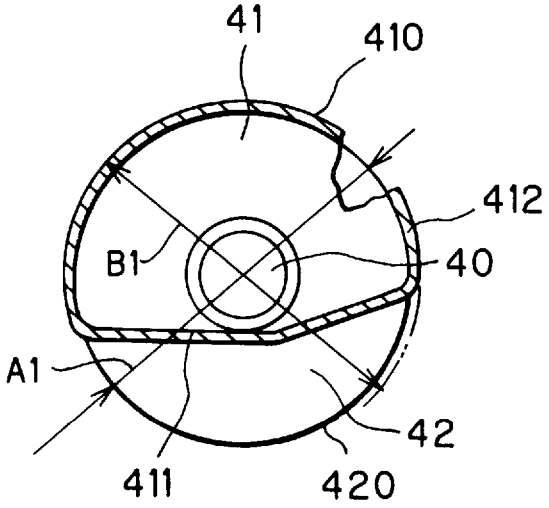
FIG. 3 is an enlarged view showing a sheet feed roller and collar of a sheet feeder in FIG. 1.

The support shaft 40 is rotatable in either the clockwise or counterclockwise direction in FIG. 1 by a drive source (not shown). As shown in FIG. 3, the sheet feed roller 41 has an arcuate or semi-cylindrical portion 410 which is concentric with the support shaft 40, and a chordal portion 411. A combination of the arcuate portion 410 and the chordal portion 411 will provide a generally sector shaped feed roller 41. The sheet feed roller 41 is integrally rotatable with the support shaft 40, and the outer periphery of the arcuate portion 410 and chordal portion 411 are covered with a friction member 412, such as rubber for increasing a coefficient of friction. The arcuate length of the arcuate portion 410 is long enough in the peripheral direction thereof to feed a single sheet S to a location between a conveyor roller 70 and follower roller 71 of the conveyor mechanism 7 (see FIG. 1).

The collar 42 is formed in a disk shape having an outer peripheral surface 420 with a specific radius of curvature, and is rotatable with respect to the support shaft 40. An outer diameter A1 of the collar 42 is set slightly smaller than an outer diameter B1 (the outer diameter including the friction member 412) of the arcuate portion 410 of the sheet feed roller 41. Further, the outer peripheral surface 420 of the collar 42 is positioned radially outwardly from the chordal portion 411.

When the support shaft 40 is rotated in the clockwise direction in FIG. 1, and the arcuate portion 410 of the sheet feed roller 41 is brought into confrontation with the hopper 3, the sheet S which has been lifted by the lifter plate 31 is pressed against the arcuate portion 410, which causes the uppermost sheet S to be pushed out of the hopper 3. When the rotation of the sheet feed roller 41 proceeds and the chordal portion 411 is brought into confrontation with the hopper 3, the portion of the sheet S remaining in the hopper 3 is brought into contact with the outer peripheral surface of the collar 42. As a result, upon completion of the delivery of the sheet S, the collar 42 is rotated in contact with the sheet S because of the feeding of the sheet S fed by the conveyor mechanism 7, while the sheet feed roller 41 is separated from the sheet S. Accordingly, floating of the sheet S can be prevented by the collar 42 until subsequent sheet feeding operation. As a result, the multiple feed (the state of two or more sheets being fed together) caused by the floating of the sheet S can be prevented.

The outer diameter Al of the collar 42 should be set to between 94 and 97% of the outer diameter B1 of the sheet feed roller 41. If the outer diameter Al is less than 94%, the lifter plate 31 will oscillate up and down greatly when a contact between the sheet feed roller 41 and an opponent confronting member (i.e., sheet S) is changed to a contact between the collar 42 and the opponent confronting member. This shock may cause the sheet S to slide down to the leading edge side of the hopper 3, which leads to multiple feed. On the other hand, if the outer diameter A1 exceeds 97%, the elastic deformation of the sheet feed roller 41 in the radial direction thereof will be restrained by the collar 42 when the sheet feed roller 41 is brought into contact with sheet S, As a result, insufficient frictional force between the sheet feed roller 41 and the sheet S results, so that sufficient sheet feeding force may not be applied to the sheet S. The outer diameters A1 of the various collars 42*a* through 42*e* may be set to different values from one another within the above-mentioned suitable range. Alternatively these collars 42*a* through 42*e* may all have identical diameter.

As shown in FIG. 2, the sheet feed rollers 41*a,* 41*b* are disposed at symmetrical positions with each other with respect to a center line L of the hopper 3 regarding the lateral direction of the sheet S. Further, regarding the collars 42*a* through 42*e,* a first collar 42*a* is positioned on the center line L, that is, a distance between the first collar 42*a* and the first feed roller 41*a* is equal to a distance between the first collar 42*a* and the second feed roller 41*b*. A second collar 42*b* is positioned between the first collar 42*a* and the first sheet feed roller 41*a* on the side close to the first sheet guide 32. A third collar 42*c* is positioned between the first sheet guide 32 and the first sheet feed roller 41*a*. A fourth collar 42*d* is positioned between the first collar 42*a* and the second sheet feed roller 41*b* on the side away from the first sheet guide 32. A fifth collar 42*e* is positioned between the second sheet feed roller 41*b* and the second sheet guide 33. Incidentally, numbers of contacting regions between the sheet S and the sheet feed rollers 41*a,* 41*b* and the collars 41*a* through 41*e* are varied depending upon a width of the sheet. The second and fourth collars 42*b* and 42*d* are provided symmetrically with each other with respect to the center line L, and the third and fifth collars 42*c* and 42*e* are also provided symmetrically with each other with respect to the center line L regarding the widthwise direction of the sheet S.

A distance D1 between the first sheet guide 32 and the first collar 42*a* is the same as or slightly less than a minimum width Wmin of the sheet that can be used in the printer. Therefore, as shown in FIG. 2, when a standardized sheet S1 having the minimum width Wmin is loaded so that a major side of the sheet S1 is oriented in the sheet feeding direction (this state is indicated by hatching in FIG. 2), the sheet S1 will come into contact with the first sheet feed roller 41*a* and the first through third collars 42*a,* 42*b* and 42*c* (three collars). A Japanese postal card (100×148 mm) is assumed here as the smallest sheet S1. Of course, a sheet having another dimension is available as a minimum size sheet.

A distance D2 between the first sheet guide 32 and the second sheet feed roller 41*b* is the same as or slightly less than the major-side length of the above-mentioned smallest sheet S1. Therefore, when the smallest sheet S1 is loaded so that the minor side of the smallest sheet S1 is oriented in the sheet feeding direction (this state is indicated by another hatching), the sheet S1 will come into contact with both of the first and second sheet feed rollers 41*a* and 41*b* and with the first through fourth collars 42*a* through 42*d* (four collars).

A distance D3 between the first sheet guide 32 and the fifth collar 42*e* is slightly less than the maximum sheet width Wmax that can be used in the printer. Therefore, when the sheet S2 having the maximum sheet width Wmax is loaded, the sheet S2 will come into contact with the first and second sheet feed rollers 41*a* and 41*b* and first through fifth collars 42*a* through 42*e* (five collars). A minor-side length of A4-size sheet (210×297 mm) or letter-size sheet (216×279 mm) is assumed as the maximum width Wmax of the sheet.

A distance D4 between the first sheet feed roller 41*a* and the second collar 42*b* or between the second sheet feed roller 41*b* and the fourth collar 42*d* is sufficiently less than a distance between the first and second collars 41*a* and 42*b* or between the first and fourth collars 42*a* and 42*d*. In other words, the second and fourth collars 42*b* and 42*d* are positioned close to the first and second sheet feed rollers 41*a*, 41*b*, respectively. Thus, the sheet S can be held by the second and fourth collars 42*b* and 42*d* in the vicinity of the sheet feed rollers 41*a* and 41*b*, whereby multiple feed of sheets S can be effectively prevented. Furthermore, when the sheet S is also held by the third collar 42*c* and the fifth collar 42*e* from the side opposite the collars 42*b* and 42*d* with respect to the sheet feed rollers 41*a* and 41*b*, respectively, the multiple feed caused by the floating of the sheet S can be prevented even more effectively. Further, a distance between the third collar 42*c* and the first sheet feed roller 41*a* or between the fifth collar 42*e* and the second sheet feed roller 41*b* is greater than the distance D4.

The friction members 36 includes a pair of friction members 36*a* and 36*b* formed on the lifter plate 31. The first friction member 36*a* confronts the first sheet feed roller 41*a* and the second collar 42*b*, whereas the second friction member 36*b* confronts the second sheet feed roller 41*b* and the fourth collar 42*d*. With this arrangement, biasing force of the spring 35 exerting on the lifter plate 31 can be linearly applied to the sheet feed roller 41*a*, 41*b*, collars 42*b*, 42*d* and the friction members 36*a*, 36*b*. Consequently, the friction members 36*a*, 36*b* can provide efficient sheet separating function.

Figure 4:
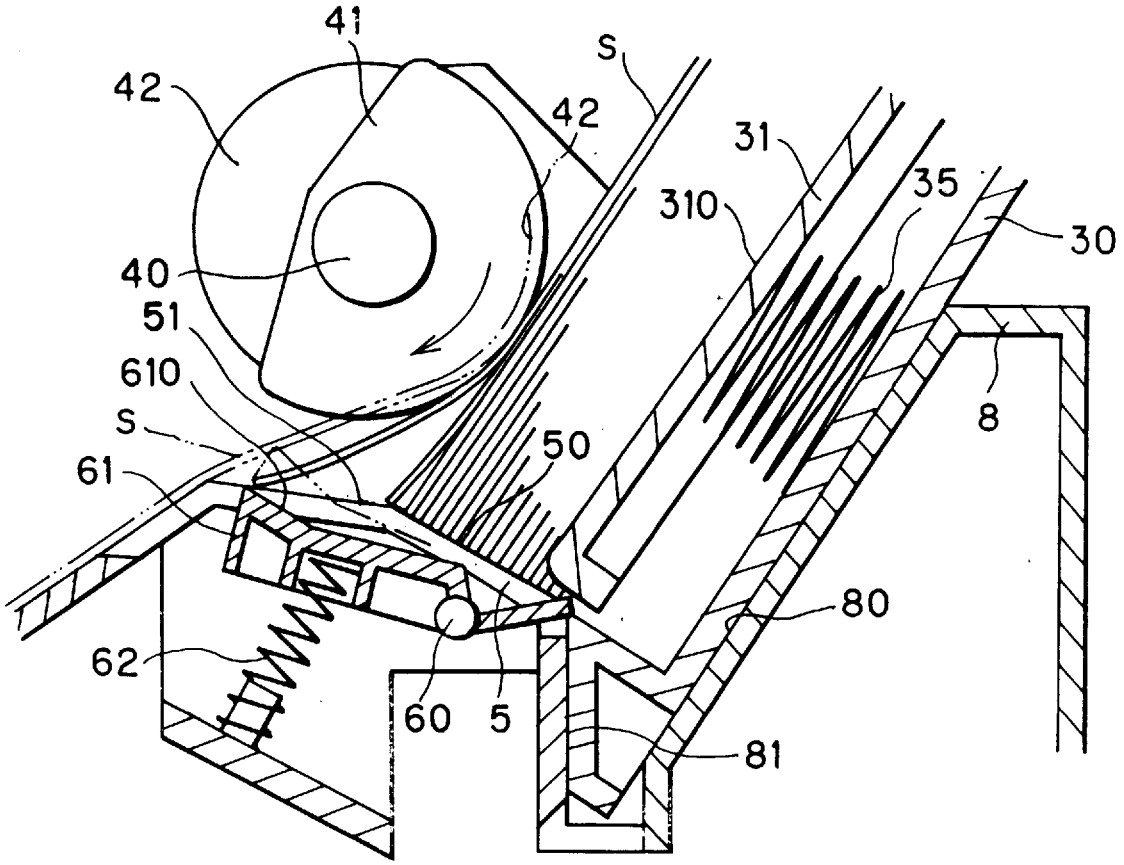
FIG. 4 is a cross-sectional view showing a state in which a stop member has been pushed in by a sheet having high rigidity according to the first embodiment.
Figure 5A:
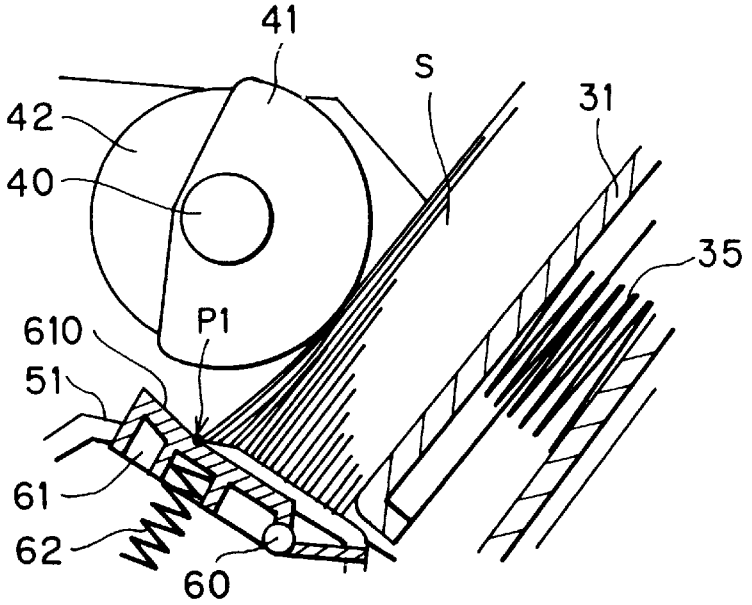
FIG. 5(*a*) through 5(*c*) are cross-sectional views showing a state in which the stop member is at its most protruding position; and in which FIG. 5(*a*) shows a state in which a leading edge of a sheet having a low rigidity abuts a portion P1.
Figure 5B:
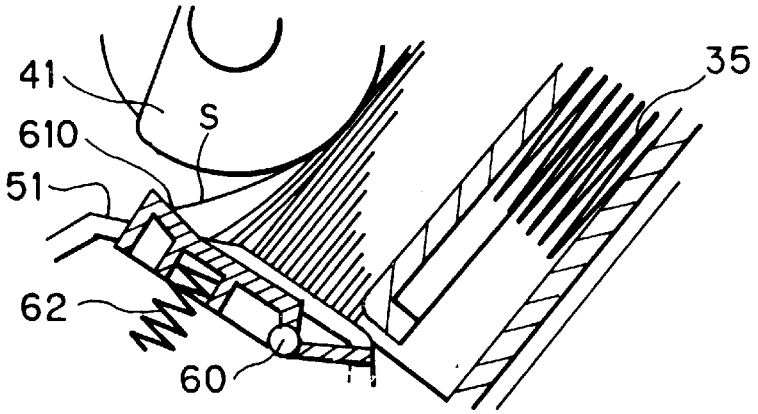
Figure 5C:
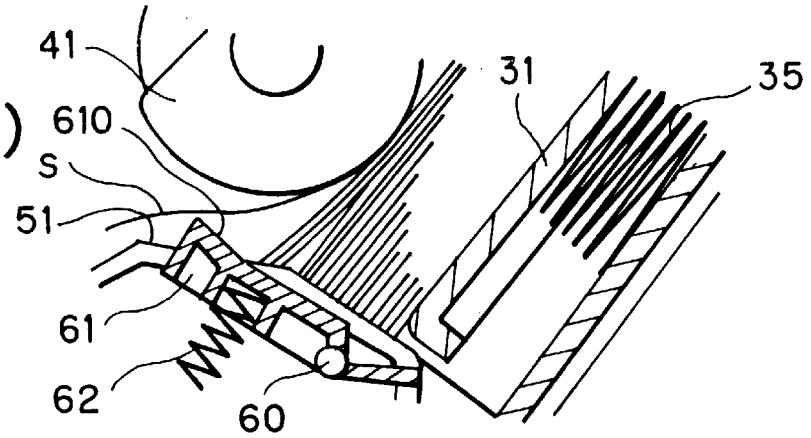

As shown in FIGS. 1, 4 and 5, the wall 5 is provided integrally with the printer frame 8. A sheet receiving surface 50 is formed on the wall 5 for receiving each leading edge of the sheet S. Further, a slanted surface 51 is provided beside and downstream of the sheet receiving surface 50. The sheet receiving surface 50 extends approximately perpendicular to the lifter plate 31, and the slanted surface 51 is angled with respect to the sheet receiving surface 50 in a direction toward the extending direction of the sheet P in the sheet cassette 30. In other words, a combination of the sheet receiving surface 50 and the slanted surface 51 provides an obtuse angled ridge. The sheet S fed from the sheet feed cassette 30 goes over the wall 5 and moves to the conveyor mechanism 7. As shown in FIG. 2, a cut-out hole 510 is formed in the slanted surface 51, and the above-mentioned stop mechanism 6 is located inside this cutout hole 510.

Upwardly projecting linear ribs 511 are formed at the slanted surface 51. These ribs 511 extend in the sheet feeding direction. The uppermost surface of the ribs 511 define the slant angle of the slanted surface 51.

The stop mechanism 6 will be described. The stop mechanism 60 includes a support shaft 60, a stop member 61, a coil spring 62 and an arm 63. The support shaft 60 is supported by the printer frame 8 and extends in parallel to the lateral direction of the sheet S and is positioned below the bottom side of the hopper 3. The stop member 61 is pivotally movably supported to the support shaft 60 and can be projected into and retracted from the slanted surface 51. The coil spring 62 is interposed between the printer frame 8 and the stop member 61 for urging the stop member 61 to project from the slanted surface 51 toward the hopper 3. The arm 63 is provided integrally with the stop member 61. A free end of the arm 63 is abutable against an open edge of the cut-out hole 510 for defining the most protruding position of the stop member 61 from the slanted surface 51. The stop member 61 is provided with a contact surface 610 adapted for making contact with the sheet S.

In a state in which the stop member 61 is protruding from the slanted surface 51, the slope of the contact surface 610 is greater than that of the slanted surface 51 with respect to the sheet feeding direction. More specifically, as shown by a dotted chain line in FIG. 4, an angle defined between the contact surface 610 and the sheet S in the hopper is less than 90 degrees. In the state in which the stop member 61 is protruding from the slanted surface 51, a maximum angle defined between the contact surface 610 and the sheet S in the hopper is 90 degrees as shown in embodiments with reference to FIGS. 13 and 14 described later.

As shown in FIG. 5(*a*), when the stop member 61 has the most protruding posture protruding from the slanted surface 51, i.e., when the arm 63 abuts the open edge of the cut-out hole 510, an intersecting position P1 defined by the intersection between the contact surface 610 and the slanted surface 51 is approximately coincident with a position where the leading edge of the sheet S fed from the hopper 3 abuts the wall 5. Incidentally, angle of the lifter plate 31 changes according to the number of sheets S stacked inside the hopper 3, and accordingly, the abutting position of the leading edge of the sheet S against the wall 5 also changes. Therefore, the above-mentioned intersection position P1 should preferably be set as a reference point when the contact position of the leading edge of the sheet S with the wall 5 deviates as much as possible toward the slanted surface 51 side, that is, when the number of sheets of sheet S inside the hopper 3 is the smallest. More specifically, if only one sheet is stored in the sheet cassette 30, the pivotally moving stroke of the lifter plate 31 in a clockwise direction in FIG. 5 becomes the largest because of the smallest weight of the sheet. If voluminous sheets are stacked on the lifter plate 31, the lifter plate 31 is to be moved in a counter-clockwise direction due to heavy weight of the sheet stack. Even if the uppermost sheet is positioned close to the slanted surface 51 because of the thickness of the sheet stack, the uppermost position is still positioned farther to the slanted surface 51 than the only one sheet stored to the slanted surface 51. Further, the position P1 varies due to the variation in rigidity of the sheet S. In this case, the position P1 can be determined based on a specific case where the sheet S having the highest rigidity is used.

The stop member 61 and the printer frame 8 are made from a resin, and rigidity of the stop member 61 is set high enough capable of maintaining a constant shape against the pressing force of the sheets S abutting the contact surface 610. The sheet separating performance may be more stable than a case where the stop member is made from a soft material. Furthermore, since a wider variety of materials can be selected in a rigid stop member, a stop member with improved durability and lower cost can be designed, which allows the manufacturing costs to be reduced.

The biasing force exerted on the stop member 61 by the coil spring 62 is set so that the stop member 61 can protrude from or retracted into the slanted surface 51 in accordance with the rigidity of the sheet S, which ensures a sheet separation effect suited to the rigidity of the sheet S.

More specifically, when a sheet S having high rigidity (such as a postcard, envelope, or other thick sheet) presses on the contact surface 610, the stop member 61 is pushed in to about the same plane as the slanted surface 51 as indicated by a solid line in FIG. 4 due to high rigidity of the sheet, and the leading edge of the sheet S slides over the slanted surface 51 as the sheet S is fed from the hopper 3. In other words, the contact surface 610 of the stop member 61 does not function to promote separation performance of the uppermost sheet from the remaining sheet, but the slanted surface 51 primarily performs the sheet separation in case of the sheet having high rigidity or linearity. In this instance, even if a plurality of sheets S are fed simultaneously from the hopper 3, these sheets S are easily separated from one another by means of the flexion thereof when the leading edge is slidingly moved along the slanted surface 51. As a result, only the uppermost sheet S is pushed by the sheet feed roller 41 and goes over the slanted surface 51.

On the other hand, when a thin sheet S having low rigidity abuts the stop member 61, as shown in FIG. 5(*a*), the stop member 61 cannot be retracted into the slanted surface 51 but maintains its protruding posture with respect to the slanted surface 51 by the biasing force of the coil spring 62, because the biasing force is greater than the rigidity of this sheet S. Thus, the sheet S is fed up and over the stop member 61, as shown in FIGS. 5(*b*) and 5©. In this case, the leading edge of the sheet S is largely bent in comparison with the case where the stop member 61 is positioned beneath the slanted surface 51. Accordingly, sufficient separation is achieved even with sheet S having low rigidity, and the sheet S positioned below the uppermost sheet is effectively retained by the stop member 61.

In this way, the sheet S having low rigidity can be separated exclusively by the stop member 61. Therefore, the slope angle of the slanted surface 51 can be properly set taking the separation effect of only the sheet S having high rigidity into consideration. This allows a variety of types of sheet S to be separated effectively regardless of the rigidity of the sheet. Incidentally, if the slope angle of the slanted surface 51 is set extremely large for facilitating sheet separation with respect to the sheet having low rigidity, a sheet having high rigidity may not be able to pass over the steep slanted surface 51, and the slipping rotation of the sheet feed roller 41 may occur while the sheet S still retained inside the hopper 3.

Optimum biasing force of the coil spring 62 may be determined based on various factors such as rigidity of the sheet S being used, the maximum weight of the sheet stack housed in the hopper 3, an angle defined between the slanted surface 51 and the sheet S housed in the hopper 3, the force at which the sheet feed roller 41 presses the sheet S, and the force at which the lifter plate 31 pushes the sheet S toward the sheet feed roller 41. However, the biasing force may be not more than 200 g, preferably, not more than 160 g, taking total weight of the sheet in the hopper 3 into consideration, which is equivalent to the force capable of pushing the stop member 61 to a position beneath the slanted surface 51.

A friction member may be attached to the contact surface 610 of the stop member 61. Alternatively, the contact surface 610 may be machined so as to increase the coefficient of friction, so that the sliding resistance will be increased as the sheet S goes over the stop member 61. However, the frictional force between the sheet S and the stop member 61 must be less than the frictional force between the sheet feed roller 41 and the sheet S in order to avoid slipping rotation of the sheet feed roller 41 on the sheet S.

As shown in FIG. 2, the stop member 61 is positioned on the center line L extending at a center of the pair of sheet feed rollers 41 in relation to the lateral direction of the sheet S. Therefore, a common stop member 61 can be used both for the sheet S1 that comes into contact only with the first sheet feed roller 41*a* and for the sheet S2 that comes into contact with both of the sheet feed rollers 41*a* and 41*b*. Therefore, the only one stop member 61 is sufficient. Also, since the resistance of the stop member 61 is applied to a position in the approximate center of the pair of sheet feed rollers 41*a* and 41*b*, the diagonal feeding of the sheet S can be prevented.

The slanted surface 51 is formed with recesses 512 at positions in alignment with the pair of sheet feed rollers 41 in the sheet feeding direction. As shown by the imaginary line S' in FIG. 2, the leading edge of the sheet S pushed by the sheet feed roller 41 is deformed such that it falls into the recesses 512, and at the same time is pushed back in the opposite direction by the stop member 61 at the approximate center position between the neighboring recesses 512. This enhances the separation effect of the sheet S from the remaining sheets. The width of the recesses 512 is set greater than the width of the sheet feed roller 41. However, the width of the recesses can be set equal to or less than the width of the sheet feed roller 41. Further, the configuration of the recesses 512 can be the same as the configuration of the cut-out hole 510, and the stop mechanism 6 can be positioned inside the recesses 512.

Figure 6:
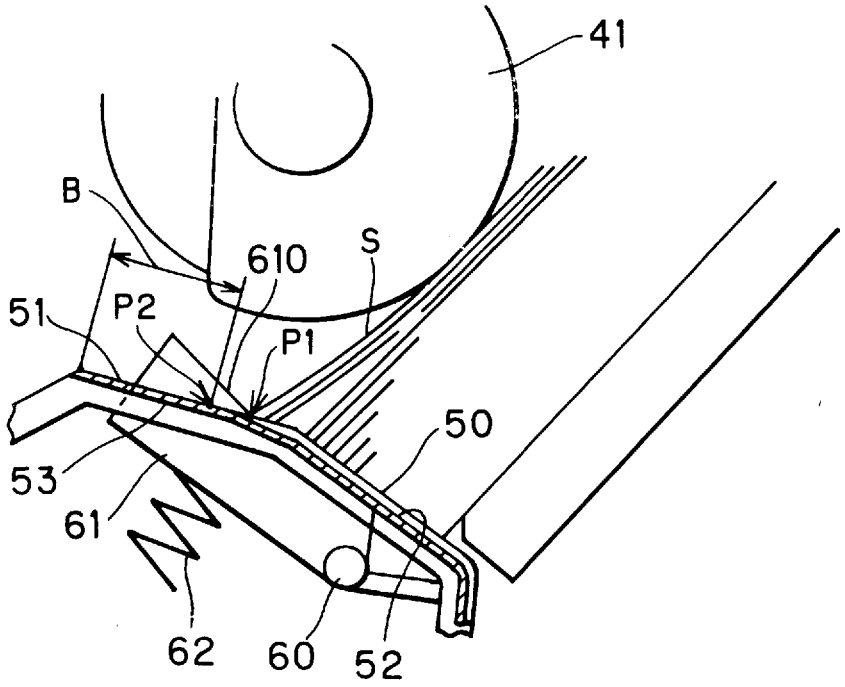
FIG. 6 is a cross-sectional view taken along the line VI—VI in FIG. 2.

As shown in FIGS. 2 and 6, a pair of grooves 52 are formed in the wall 5 in alignment with the stop member 61 in the lateral direction of the sheet S. Further, each friction member 53 is adhesively bonded to each groove 52. These friction members 53 extend out of the grooves 52 toward the downstream side in the sheet feeding direction, and are exposed on the slanted surface 51. These friction members 53 improve the sheet separation performance of the slanted surface 51 by setting the coefficient of friction of the slanted surface 51 higher than that of the contact surface 610 of the stop member 61. The upper surface of the part of the friction members 53, the part being exposed on the slanted surface 51, is flush with the upper surface of the ribs 511.

A position P2 (FIG. 6) where the friction members 53 are exposed on the slanted surface 51 is positioned downstream of the point P1 in the sheet feeding direction, the position P1 being the position where the slanted surface 51 intersects with the contact surface 610 of the stop member 61 maximally protruding from the slanted surface 51.

The positional relationship between the positions P1 and P2 is due to the following reason. At an initial start-up period for starting rotation of the sheet feed roller 41, it is necessary to avoid slipping rotation of the sheet feed roller so as to surely start sheet feeding operation. To this effect, it is necessary to reduce the static frictional force between the wall 5 and the leading edge of the sheet S which have been abutting on the wall 5. On the other hand, after the sheet has begun to move, it is necessary to enhance sheet separation efficiency by increasing frictional resistance between the sheet S and the slanted surface 51. Thus, the position P2 should be downstream of the position P1.

The friction members 53 are preferably positioned symmetrically with each other with respect to the center line L. With this arrangement, constant power difference or balance can be provided between the resistance of the friction members 53 and the feed force acting on the sheet S by the sheet feed roller 41, thereby preventing diagonal feeding of the sheet. This is the same as the relation between the sheet feed roller 41 and the stop member 61.

The friction members 53 is made of a polyester film and alumina particles adhering to the surface of the polyester film. Alternatively, other known high-friction materials are available. Instead of the formation of the grooves 52 in the wall 5, it is also possible to stick the friction members 53 to the slanted surface 51 at an area away from and downstream of the position P2 in the sheet feeding direction. However, formation of the groove 52 is advantageous in that the part of the friction members 53 can be accommodated in the grooves 52. If the friction members 53 are merely adhered on the surface of the wall 5, the leading edge of the sheet S may abut on the end of the friction member so that the end of the friction member may be peeled off from the wall 5. Further, formation of the groove 52 has another advantage in that contacting surface area between the friction members 53 and the wall 5 can be increased, which can enhance the bonding force of the friction member to the wall. After the sheet S is moved past the wall 5, the sheet S is guided between the conveyor roller 70 and the follower roller 71 of the conveyor mechanism 7. The conveyor roller 70 is rotationally driven in the clockwise direction in FIG. 1 until the sheet S has been fed by a specific length by the sheet feed roller 41. Thereafter, the conveyor roller 70 is rotationally driven in the counterclockwise direction. This allows the leading edge of the sheet S to be bring into alignment with the axial direction of the conveyor roller 70. As a result, the precisely oriented sheet S can be delivered to the printing mechanism 1.

As described above, according to the sheet feeder of the illustrated embodiment, since the stop member 61 is always positioned between the sheet feed roller and the sheet guide, that is, the stop member 61 is positioned between the first sheet guide 32 and the second sheet feed roller 41*b* (or between the second sheet guide 33 and the first sheet feed roller 41*a*), the sheet fed by the sheet feed roller 41 will surely be in contact with the stop member. Even if the stop member is contacted with the sheet at its deviated position, diagonal feeding of the sheet can be prevented by the sheet guides 32, 33. Further, since the stop member 61 is positioned between the first and second sheet feed rollers 41*a*, 41*b*, the sheet is surely contacted with the single stop member 61. This can reduce the number of the stop member to a single stop member. Further, the sheet is imparted with sheet feeding force by the sheet feed rollers at both transverse sides of the sheet with respect to the contacting portion of the sheet with the stop member. Therefore, diagonal feeding is avoidable.

Further, in the sheet feeder according to the first embodiment, either the slanted surface 51 or the stop member 61 selectively protrudable from the slanted surface can be used for selectively imparting a separation action on the sheets depending upon the rigidity of the sheets. Further, the separation performance of the stop member can be variously adjusted by changing biasing force of the spring 62 or by changing the properties, such as frictional coefficient and slope angle, of the contact surface 610. Therefore, a highly reliable sheet feeder capable of effectively separating a variety of types of sheets can be provided.

A sheet feeder according to a second embodiment will be described with reference to FIG. 7. In the second embodiment, two stop mechanisms 6 are provided, and each stop mechanism 6 is positioned on an extension in the sheet feeding direction of each sheet feed roller 41*a* and 41*b*. In this case, the sheet feeding forces provided by the sheet feed rollers 41*a* and 41*b* are linearly imparted on the stop members 61 located on the lines of action of these rollers. Therefore diagonal movement of the sheet S can be effectively prevented.

Figure 8:
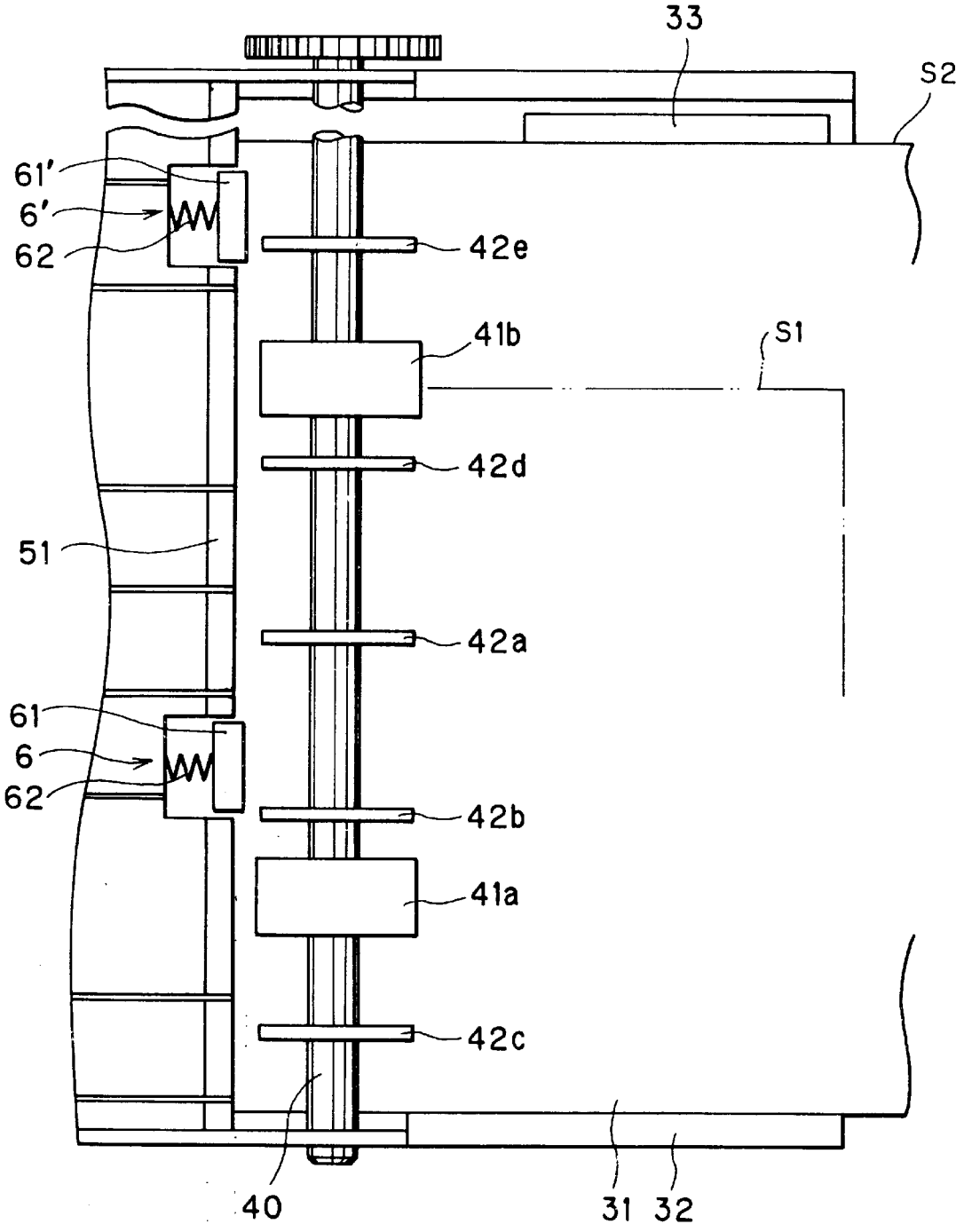
FIG. 8 is a plan view showing a sheet feeder according to a third embodiment in which positions of the stop members are different from the arrangement shown in FIG. 7.

A sheet feeder according to a third embodiment is shown in FIG. 8. In the third embodiment, a distance between the stop mechanism 6 and the first sheet feed roller 41*a* in the lateral direction of the sheet is smaller than the distance in the first embodiment, and further, a second stop mechanism 6' is added at a position between the second sheet feed roller 41*b* and the second sheet guide 33. In this case, a wide sheet S2 can be in contact with the two stop members 61, 61', whereas a narrow sheet S1 can be in contact with the stop member 61 only. If only one stop mechanism is provided, load or resistance applied to the stop mechanism from the sheet may be varied depending on the size, i. e., weight of the sheet. Taking this into consideration, in the third embodiment, since the wide sheet S2 can be contacted with both the stop members 61 and 61', weight of the sheet can be distributed to the two stop members 61, 61' so as to avoid excessive increase in resistance applied to one stop member. As a result, sufficient sheet separation effect can be obtained regardless of the width of the sheet.

Figure 7:
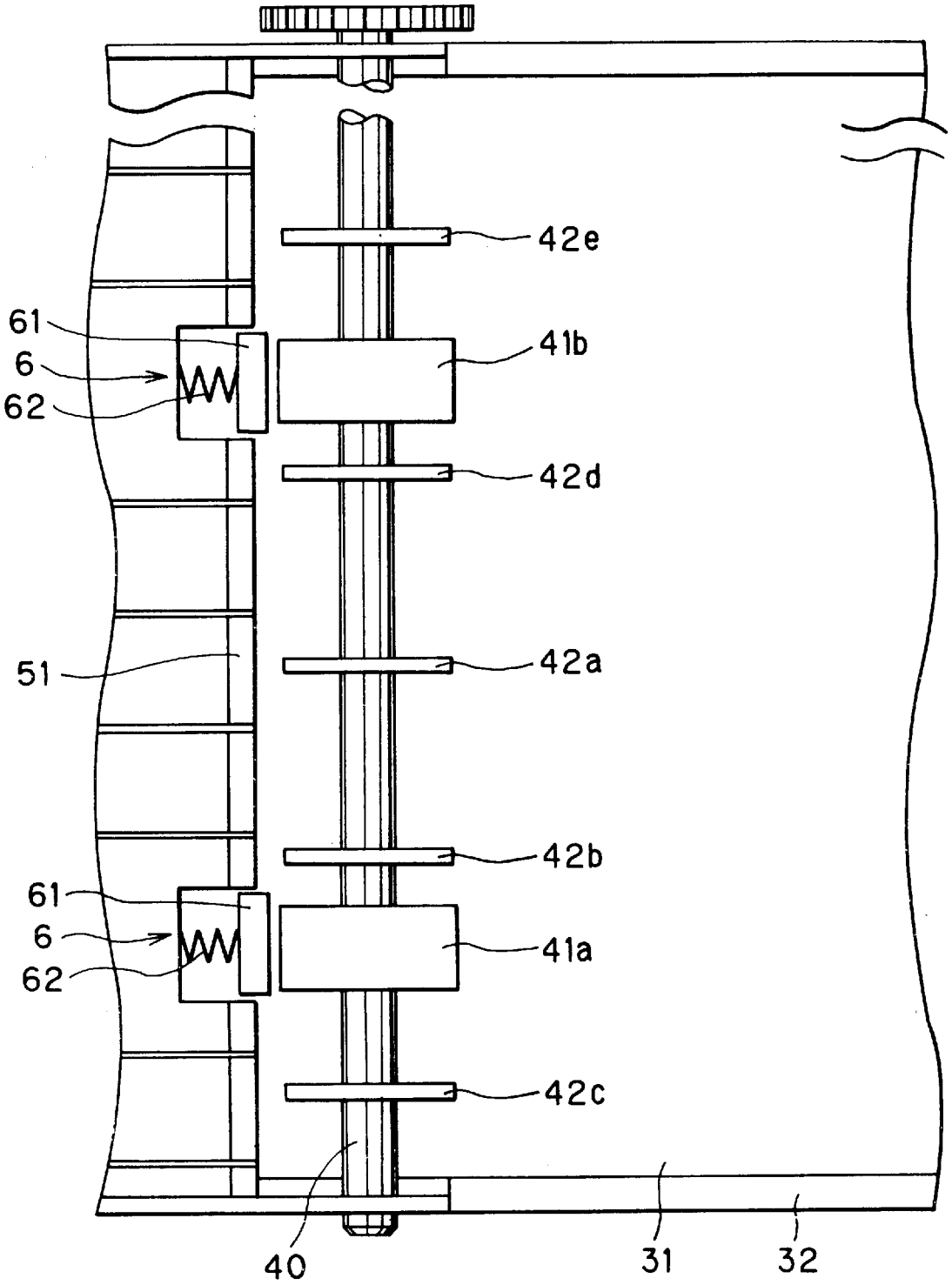
FIG. 7 is a plan view showing a sheet feeder according to a second embodiment in which two stop members are provided.

Incidentally, if a plurality of stop mechanisms 6 are provided as shown in FIGS. 7 and 8, it is necessary to limit the variance in the biasing force at which each stop member 61 pushes the sheet S. The tolerable range for variance should be set to within ±50%, and preferably to within ±10% of a load required to push the stop member 61 below the slanted surface 51.

Figure 9:
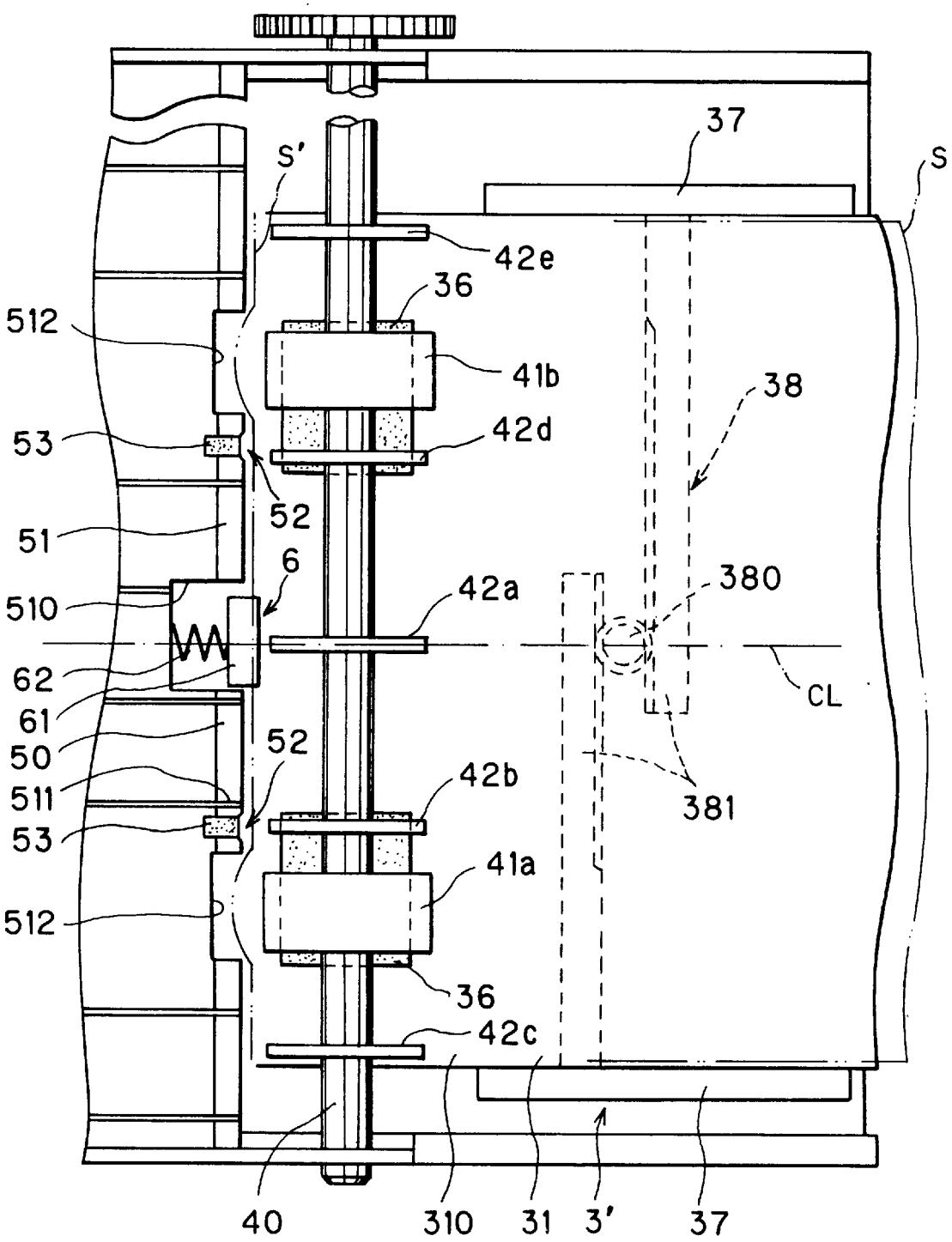
FIG. 9 is a plan view showing a sheet feeder according to a fourth embodiment which provides an alignment between a center line of the sheet and a center line of a hopper.

A sheet feeder according to a fourth embodiment is shown in FIG. 9. In the fourth embodiment a pair of sheet guides 37, 37 are interlockingly movably provided in the lateral direction of the sheet S instead of using the sheet guides 32 and 33 in FIG. 2. The sheet guides 37, 37 are linked to each other via an interlocking mechanism 38. The interlocking mechanism 38 includes a common pinion gear 380 and a pair of racks 381 extending in the lateral direction of the sheet S and meshedly engaged with the pinion gear 380. Each sheet guide 37 is connected to each racks 381. By the interlocking mechanism 38, the sheet guides 37 move symmetrically in the lateral direction of the sheet S with respect to the center line CL of the hopper 3'. Accordingly, a center line of the sheet S stored in the hopper 3' coincides with the center line CL of the hopper 3' regardless of the sheet width.

The pair of sheet feed rollers 41*a* and 41*b* are arranged symmetrically with respect to the center line CL of the hopper 3', and a single stop mechanism 6 is provided on the center line CL. Therefore, regardless of the width of the sheet S, the sheet S will be contacted with the stop member 61 at the center position in the lateral direction thereof. Accordingly, only one stop member 61 is sufficient for any sizes of sheet S. Also, the force at which the sheet feed rollers 41*a* and 41*b* feed the sheet S, and the force at which the stop mechanism 6 pushes back the sheet S act symmetrically with respect to the center line CL. Accordingly, the diagonal feeding of the sheet S is effectively prevented. As a modification, a plurality of stop members can be provided symmetrically with respect to the center line CL of the hopper 3. In any event, in the fourth embodiment, the sheet S can be contacted with the stop member(s) in symmetrical fashion with respect to the center line CL. Therefore, uniform resistive force is imparted on the sheet from the stop member(s).

Figure 10:
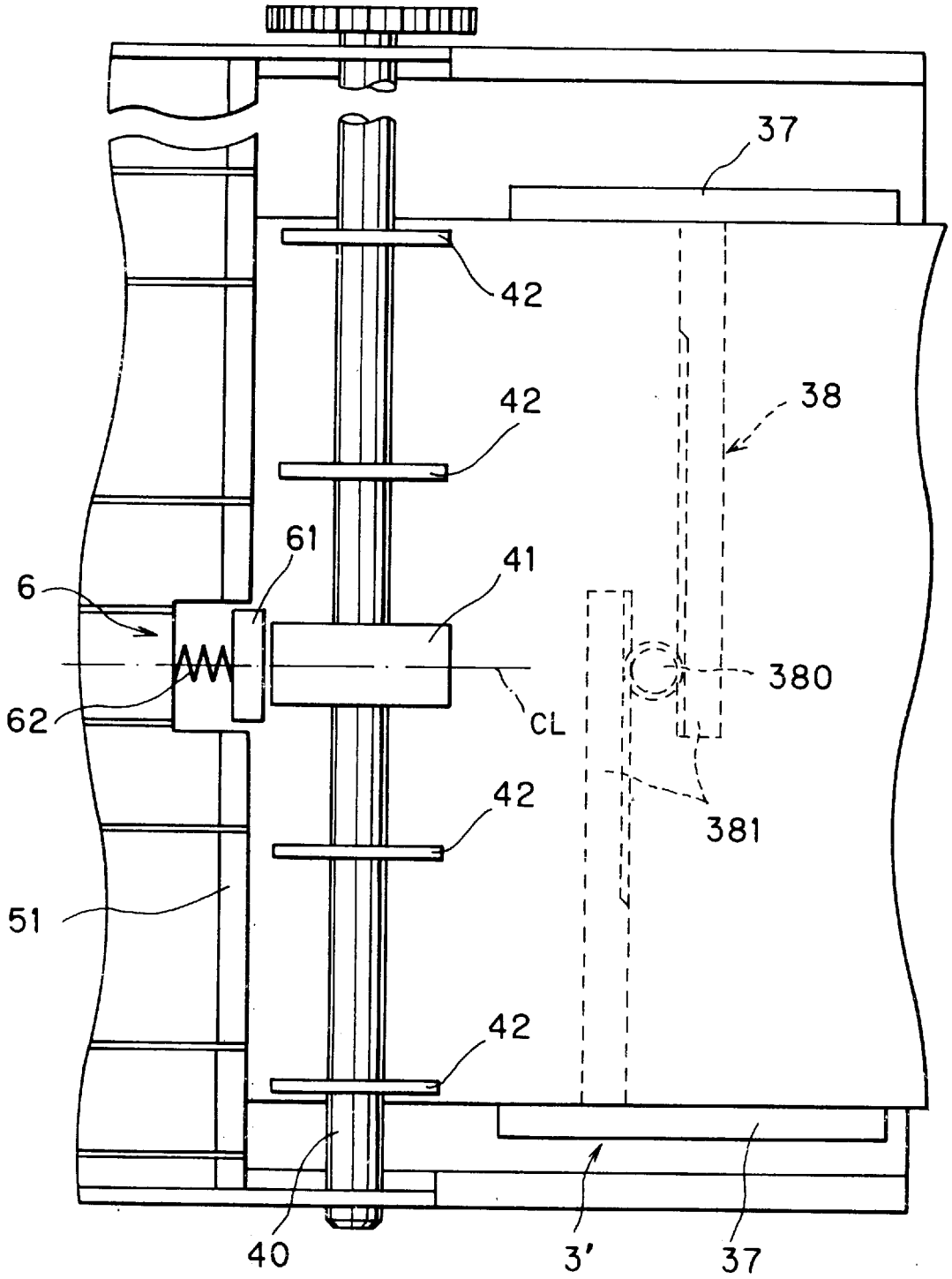
FIG. 10 is a plan view showing a modification to the fourth embodiment.

FIG. 10 shows a modification to the fourth embodiment. Instead of the two sheet feed rollers in the fourth embodiment, the modification provides a single sheet feed roller 41 at a position in alignment with the center line CL. With this arrangement, only one sheet feed roller and only one stop member are sufficient enough for separation of sheets of various width. Further, because of the linear arrangement between the sheet feed force by the sheet feed roller 41 and the resistive force by the stop member 61, diagonal feeding of the sheet is avoidable.

Figure 11:
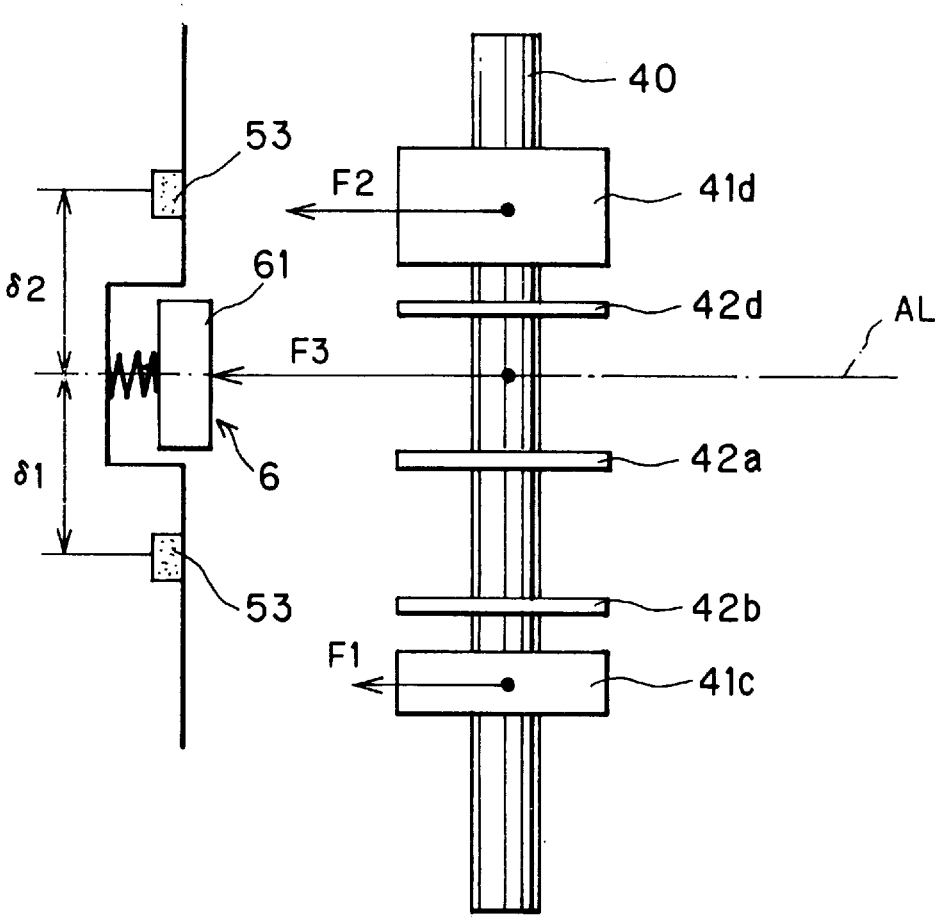
FIG. 11 is a schematic view showing a sheet feeder according to a fifth embodiment in which axial length of a pair of sheet feed rollers are different from each other.

FIG. 11 shows a sheet feeder according to a fifth embodiment. In the foregoing embodiments, axial length of the sheet feed rollers 41*a,* 41*b* is equal to each other. On the other hand, in the fifth embodiment, sheet feed rollers 41*c* and 41*d* of different axial lengths are provided. In this case, since the feed forces F1 and F2 of the sheet feed rollers 41*c* and 41*d* are different from each other, one or more stop mechanisms 6 should be positioned symmetrically in the lateral direction of the sheet S with respect to a line of action AL of a resultant force F3 of these feed forces Fl and F2. Further, the friction members 53, 53 should also be positioned symmetrically with respect to the line of action AL ($\delta 1=\delta 2$). Since the resistance from the stop member 61 is symmetrically applied to the sheet S in the transverse direction thereof with respect the line of action AL of the resultant force F3, irrespective of the different feed force F1 and F2 from the sheet feed rollers, diagonal feeding of the sheet can be obviated.

The sheet feeder in the fifth embodiment has a stationary sheet guide and a movable sheet guide in the hopper similar to the first embodiment. Further configuration of the wall portion 5 and its slanted surface and a stop member are also the same as those of the first embodiment. However, as a modification, the sheet feeder in the fifth embodiment can be incorporated into the hopper having the interlocking mechanism 38 shown in FIGS. 9 and 10.

Figure 12:
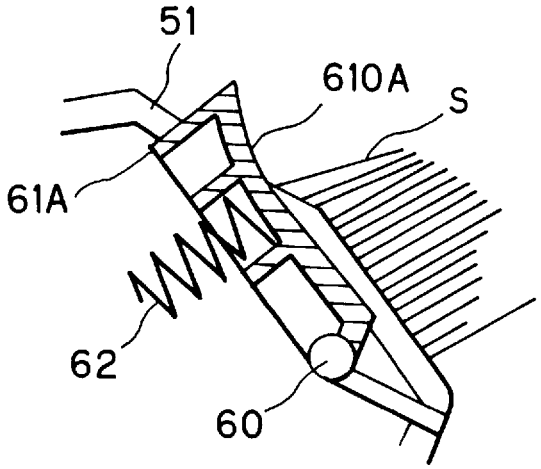
FIG. 12 is a schematic cross-sectional view showing an alternative arrangement of a stop member.
Figure 13:
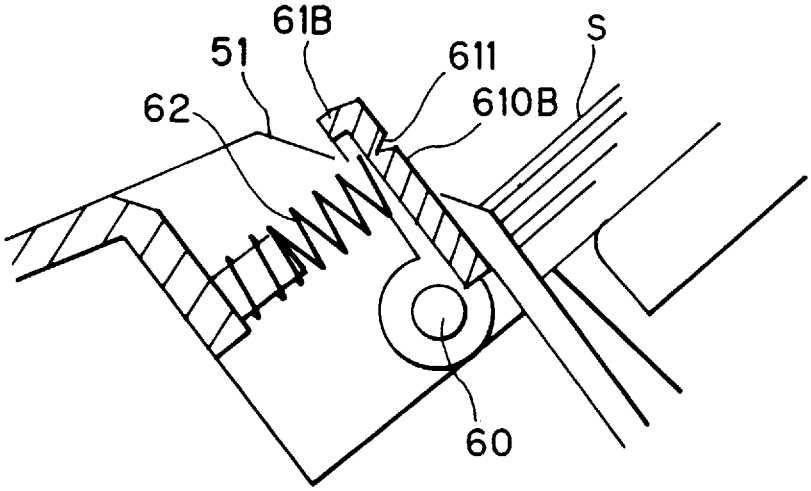
FIG. 13 is a schematic cross-sectional view showing a further alternative arrangement of a stop member.
Figure 14:
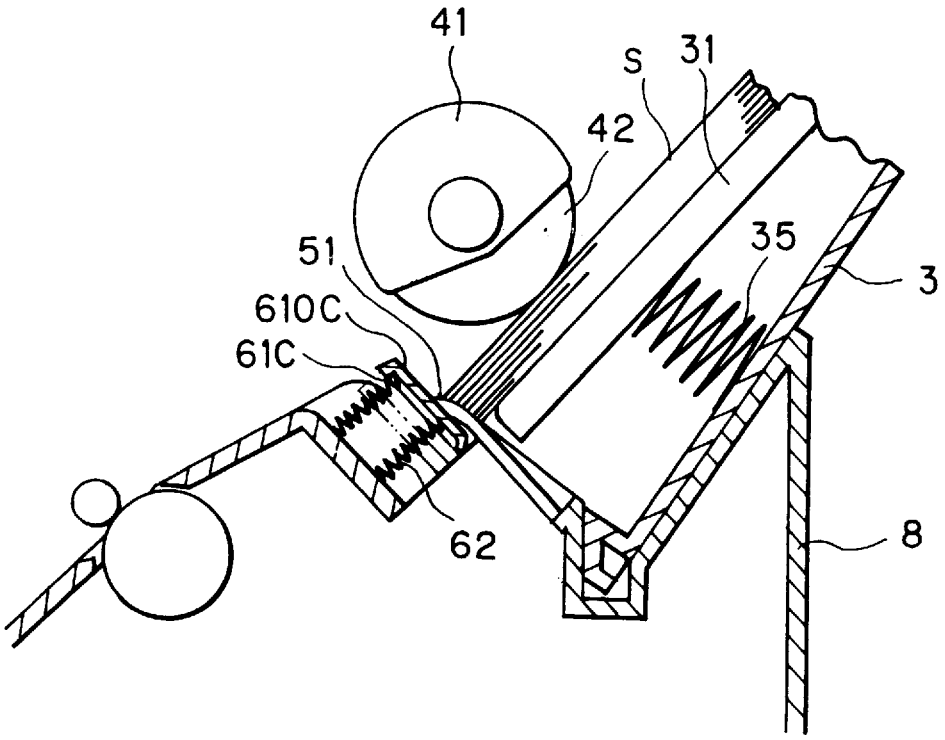
FIG. 14 is a schematic cross-sectional view showing a still further alternative arrangement of a stop member.

FIGS. 12 through 14 illustrate alternative embodiments in connection with the stopper mechanism. FIG. 12 shows a stop member 61A in which a contact surface 610A is formed in a concavely curved surface. Therefore, the contact surface 610A is gradually steeper toward the downstream side in the sheet feeding direction. Accordingly, the leading edge portion of the sheet having low rigidity can be pushed back toward the hopper 3, thereby enhancing sheet separation efficiency of the uppermost sheet from the remaining sheets.

FIG. 13 shows a stop member 61B having a contact surface 610B extending approximately perpendicular to the sheet S. The stop member 61B can provide the function the same as that of the concavely curved surface shown in FIG. 12. Further, in the contact surface 610B, a groove 611 extends in the lateral direction of the sheet S. The sheet separation effect can be enhanced by permitting the leading edge of the sheet S to engage the groove 611. That is, the leading edge of the sheet having low rigidity is temporarily trapped by the groove 611 while being fed by the sheet feed roller 41. Therefore, the leading edge portion of the sheet S is largely bent to further promote sheet separation effect.

FIG. 14 shows a stop member 61C having a contact surface 610C that is approximately perpendicular to the sheet S. Further, the stop member 61C is supported by a pair of springs 62 in such a manner that the stop member 61C can be moved in a direction parallel to the extending direction of the sheets in the hopper 3. With this arrangement, a posture of the stop member 61C is maintained constantly, i.e., the slope of the contact surface 610C is kept constant and the sheet S can be pushed back in a constant direction regardless of the position of the stop member 61C. Of course, the stop member 61C can be formed with the groove 611 shown in FIG. 13.

Figure 15:
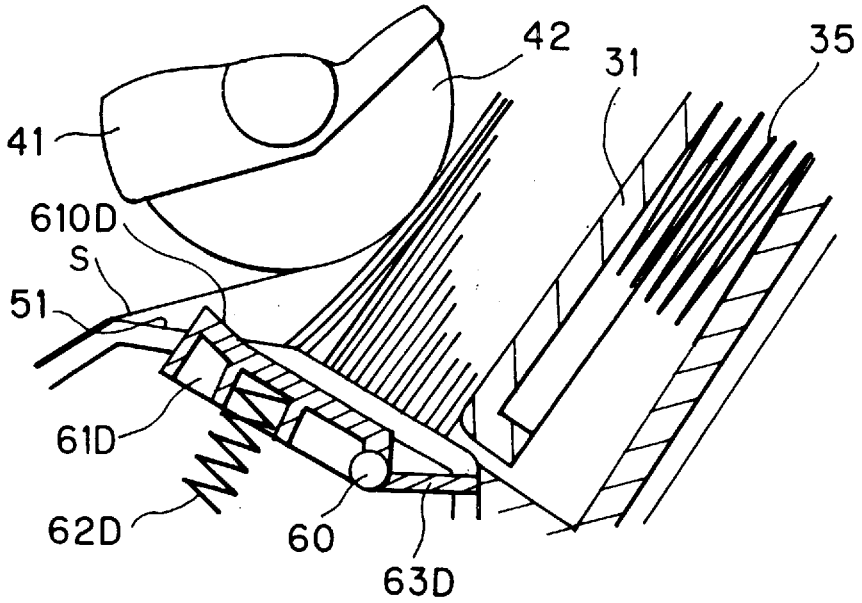
FIG. 15 is a cross-sectional view showing a still further alternative arrangement of a stop member.

FIG. 15 shows a stop member 61D having a contact surface 610D. The stop member 61D is similar to the stop member 61 of the first embodiment. However, the most protrudable position of the stop member 61D is different from that of the stop member 61. More specifically, in the first embodiment, when the leading edge of the sheet S is nipped between the conveyor roller 70 and the follower roller 71 of the conveying mechanism 7, the lower surface of the sheet S bridging between the conveying mechanism 7 and the collar 42 is in sliding contact with a free end of the stop member 61 as shown by a broken line in FIG. 4 with the free end being pressed downwardly by the sheet S. On the other hand, in the embodiment shown in FIG. 15, the stop member 62D is arranged such that the most protruding end, i.e., free end of the stop member 62D is still out of contact from the lower surface of the sheet S when the sheet S is bridging between the conveying mechanism 7 and the collar 42. This geometrical arrangement can be provided by controlling a pivot position of the stop member or abutting position of an arm 63 with the open end of the hole 510 (FIG. 2) or biasing force of an coil spring 62D.

In operation, if the leading edge of the sheet S is nipped between the conveyor roller 70 and the follower roller 71 (FIG. 1), the rotation of the sheet feed roller 41 is stopped and the collars 41 press the uppermost sheet S of the sheet stack on the lifter plate 31 as a result of a single rotation of the sheet feed roller 41. Accordingly tension is applied to the sheet bridging between the conveyor roller 70 and the collar 42. In other words, the sheet S is not slackened at a position above the slanted surface 51 but linearly extends thereabove. In this state, the lower surface of the sheet S is spaced away from the upper surface of the stop member 62D as shown in FIG. 15. Printing can be performed while maintaining this separation state.

The sheet S is intermittently fed in the sheet feeding direction so as to perform printing in line-by-line basis. During this sheet feeding, the sheet is not contacted with the stop member 61D and therefore, the sheet S can be smoothly passed over the stop member 61D during actual printing operation. In other words, accurate line feeding operation can be made by the conveyor roller without application of external resistive force. In particular, high quality image can be provided with an accurate line pitch in case of the ink jet printer in which high resolution power is needed.

While the invention has been described in detail and with reference to the specific embodiments thereof, it would be apparent to those skilled in the art that various changes and modifications may be made therein without departing from the spirit and scope of the invention.

For example, in the first embodiment, the first sheet guide 32 is stationarily provided. However, as an alternative arrangement, the position of the first sheet guide 32 can be made adjustable somewhat in the lateral direction of the sheet S, or an auxiliary sheet guide is further added to the first sheet guide 32 in accordance with the sheet width. Here again, the sheet S is positioned in the lateral direction with the first sheet guide 32 serving as a reference guide position, and the position of the second sheet guide 33 is then adjusted according to the sheet width.

Further, in the foregoing embodiment, the slanted surface 51 has a flat plane. However, a curved surface is also available as the slanted surface 51.

Further, as shown by an imaginary line in FIG. 2, an additional stop mechanism 6 may also be provided in the first embodiment between the first sheet feed roller 41*a* and the first sheet guide 32. Further, the position of the sheet feed roller 41 and the stop member 61 in relation to the sheet lateral direction can be variously altered.

Further, in the first embodiment, the friction members 53 are provided over the slanted surface. However as an alternative arrangement, a part of the slanted surface 51 may be subjected to machining so as to increase coefficient of friction, rather than using the friction members 53.

Further, a stop member 61 may be provided over an entire slanted surface 51. Further, the stop member 61 may be made of rubber or another elastic material so that it will be deformed slightly by the pushing force of the sheet S. Here again, as long as the sheet feeder has the slanted surface 51 and the contact surface 610 of the stop member 61 for selective contact with the sheet S, a greater variety of sheets can be subjected to separation in comparison with a conventional arrangement.

Further, the friction members 36 and 53 shown in FIG. 2 may also be provided in the embodiments in FIGS. 7, 8, and 10. Further, the recess 512 (FIG. 2) may be provided in the embodiment in FIG. 8.

Further, the groove 611 in the contact surface shown in FIG. 13 can be omitted.

Further, the projecting and retracting movement of the stop member relative to the slanted surface can be made manually depending on the size or rigidity of the sheet. Alternatively, the projecting position of the stop member can be maintained. Further, the sheet feeder of the present invention can also be applied to other printers, such as a laser printer, a copying machine, a facsimile, as well as to the ink jet printer. Because the sheet is fed by the sheet feeder in an accurate orientation, misprinting or insufficient printing can be avoided in these image forming device.

Further, the present invention can also be applied to a sheet feeder which holds the sheets in a horizontal orientation.

What is claimed is:

1. A sheet feeder for feeding each one of cut sheets in a sheet feeding direction comprising:

a hopper housing therein a stack of sheets, the hopper having a wall portion at a position in confrontation with each leading edge of the sheets when the stack of sheets are housed in the hopper;

at least one sheet feed roller disposed in contact with an uppermost sheet of the sheet stack for feeding the uppermost sheet in the sheet feeding direction;

the wall portion comprising a sheet receiving surface in contact with each leading edge of the sheets, and a slanted surface positioned downstream of the sheet receiving surface in the sheet feeding direction;

a stop member movable between a protruding position protruding out of the slanted surface and a retracted position retracting into the slanted surface, the stop member having a contact surface in contact with the sheet, an angle defined between the contacting surface and an initial position of the sheet in the hopper being less than 90 degrees when the stop member is in the protruding position, the initial position being one prior to a sheet feeding operation of the sheet; and a biasing member connected to the stop member for urging the stop member to the protruding position.

2. The sheet feeder as claimed in claim 1, wherein the hopper comprises a main frame and a sheet cassette mounted on the main frame, the main frame having a first part providing the wall portion and a second part positioned below the first part; and wherein the slanted surface is provided by the first part of the main frame, the slanted surface being formed with a hole in which the stop member is positioned, and wherein the biasing means is interposed between the second part and the stop member in a direction parallel to the orientation of the sheet.

3. The sheet feeder as claimed in claim 2, wherein the stop member is pivotally supported to the main frame to provide a first pivot position protrudable from the slanted surface and defining the protruding position, and a second pivot position retractable into the slanted surface and defining the retracted position, the angle defined between the contacting surface and the sheet in the hopper is less than 90 degree when the stop member is in the first pivot position.

4. The sheet feeder as claimed in claim 2, wherein the slanted surface is angled with respect to the sheet receiving surface in a direction toward the sheet feeding direction defined by an orientation of the sheets in the hopper.

5. The sheet feeder as claimed in claim 4, further comprising a conveyer roller and a follower roller in nipping relation to the conveyer roller, the conveyer roller and the follower roller being positioned downstream of the slanted surface in the sheet feeding direction for conveying the sheet fed by the at least one sheet feed roller to an intended location, and wherein the at least one sheet feed roller further comprises a collar for pressing the uppermost sheet on the hopper, the uppermost sheet bridging between the conveyer roller and the collar under tension to provide a non-slackened state at a position above the slanted surface, and wherein the stop member is positioned spaced away from the sheet when the stop member is in its protruded position during the non-slackened state of the sheet.

6. The sheet feeder as claimed in claim 1, wherein the hopper comprises a main frame, a sheet cassette supported on the main frame, and a lifter plate mounting thereon the sheet stack, the lifter plate having a base end pivotally supported to the sheet cassette and a free end biased toward the slanted surface, the at least one sheet feed roller being positioned in confrontation with the free end.

7. The sheet feeder as claimed in claim 1, wherein the hopper comprises, a sheet cassette, a lifter plate pivotally connected to the sheet cassette and mounting thereon the sheet stack, and at least one sheet guide regulating a lateral position of the sheet on the lifter plate and positioned at a lateral side of the lifter plate.

8. The sheet feeder as claimed in claim 7, further comprising at least one friction member provided on the lifter plate, the at least one friction member being positioned in confrontation with the at least one sheet feed roller.

9. The sheet feeder as claimed in claim 1, wherein the at least one sheet feed roller and the stop member are aligned with each other in the sheet feeding direction.

10. The sheet feeder as claimed in claim 1, wherein the at least one sheet feed roller and the stop member are offset from each other in the sheet feeding direction.

11. The sheet feeder as claimed in claim 1, wherein the at least one sheet feed roller comprises a first sheet feed roller having a first axial length and providing a first sheet feed force directing in the sheet feeding direction, and a second sheet feed roller having a second axial length different from the first axial length and providing a second sheet feed force directing in the sheet feeding direction, the first and second sheet feed forces providing a resultant force directing in the sheet feeding direction at a line of action, the stop member being positioned symmetrically with respect to the line of action in the widthwise direction of the sheet.

12. The sheet feeder as claimed in claim 11 further comprising at least two friction members provided on the slant surface, the friction members being positioned symmetrically with each other with respect to the line of action in the widthwise direction of the sheet.

13. The sheet feeder as claimed in claim 1, wherein the hopper further comprises at least one sheet guide positioning one lateral edge of the sheet at a predetermined position regardless of a width of the sheet; and wherein the at least one sheet feed roller comprises a plurality of sheet feed rollers spacedly and coaxially arrayed in a widthwise direction of the sheet, the plurality of sheet feed rollers comprising a closest sheet feed roller positioned closest to the at least one sheet guide and a farthest sheet feed roller positioned farthest from the at least one sheet guide among the plurality of sheet feed rollers, a first distance between the stop member and the at least one sheet guide being greater than a second distance between the closest sheet feed roller and the at least one sheet guide, and the first distance being smaller than a third distance between the farthest sheet feed roller and the at least one sheet guide.

14. A sheet feeder for feeding each one of cut sheets in a sheet feeding direction comprising:

a hopper housing therein a stack of sheets and having a wall portion at a position in confrontation with each leading edge of the sheets when the stack of sheets are housed in the hopper, the wall portion comprising a sheet receiving surface in contact with each leading edge of the sheets, and a slanted surface positioned downstream of the sheet receiving surface in the sheet feeding direction;

first and second sheet feed rollers disposed in contact with an uppermost sheet of the sheet stack for feeding the uppermost sheet in the sheet feeding direction;

a stop member movable between a protruding position protruding out of the slanted surface and a retracted position retracting into the slanted surface; and a biasing member connected to the stop member for urging the stop member to its protruding position, the first sheet feed roller providing a first sheet feed force directing in the sheet feeding direction, and a second sheet feed roller providing a second sheet feed force directing in the sheet feeding direction, the first and second sheet feed forces providing a resultant force directing in the sheet feeding direction along a resultant force line and at a line of action which is along the resultant force line, the stop member being positioned symmetrically with respect to the line of action in the widthwise direction of the sheet.

15. The sheet feeder as claimed in claim 14, further comprising at least one sheet guide positioning one lateral edge of the sheet at a predetermined position regardless of a width of the sheet.

16. The sheet feeder as claimed in claim 14, wherein the first sheet feed roller has a first axial length, and the second sheet feed roller has a second axial length different from the first axial length.

17. The sheet feeder as claimed in claim 1, wherein the angle defined between the contacting surface and an orientation of a lifter plate is less than 90 degrees when the stop member is in the protruding position.

18. A sheet feeder for feeding each one of cut sheets in a sheet feeding direction comprising:

a hopper housing therein a stack of sheets, the hopper having a wall portion at a position in confrontation with each leading edge of the sheets when the stack of sheets are housed in the hopper;

at least one sheet feed roller disposed in contact with an uppermost sheet of the sheet stack for feeding the uppermost sheet in the sheet feeding direction;

the wall portion comprising a sheet receiving surface in contact with each leading edge of the sheets, and a slanted surface positioned downstream of the sheet receiving surface in the sheet feeding direction;

a stop member movable between a protruding position protruding out of the slanted surface and a retracted position retracting into the slanted surface, the stop member having a contact surface in contact with the sheet, a maximum angle defined between the contacting surface and the sheet in the hopper being 90 degrees when the stop member is in the protruding position, the contact surface being formed with a groove extending in a widthwise direction of the sheet; and a biasing member connected to the stop member for urging the stop member to the protruding position.

19. A sheet feeder for feeding each one of cut sheets in a sheet feeding direction comprising:

a hopper housing therein a stack of sheets, the hopper having a wall portion at a position in confrontation with each leading edge of the sheets when the stack of sheets are housed in the hopper;

at least one sheet feed roller disposed in contact with an uppermost sheet of the sheet stack for feeding the uppermost sheet in the sheet feeding direction;

the wall portion comprising a sheet receiving surface in contact with each leading edge of the sheets, and a slanted surface positioned downstream of the sheet receiving surface in the sheet feeding direction;

a stop member movable between a protruding position protruding out of the slanted surface and a retracted position retracting into the slanted surface, the stop member having a contact surface in contact with the sheet, a maximum angle defined between the contacting surface and the sheet in the hopper being 90 degrees when the stop member is in the protruding position, a moving direction of the stop member between the protruding and retracting positions extending in parallel with an orientation of the sheet in the hopper; and a biasing member connected to the stop member for urging the stop member to the protruding position.

20. A sheet feeder for feeding each one of cut sheets in a sheet feeding direction comprising:

a hopper housing therein a stack of sheets, the hopper having a wall portion at a position in confrontation with each leading edge of the sheets when the stack of sheets are housed in the hopper;

at least one sheet feed roller disposed in contact with an uppermost sheet of the sheet stack for feeding the uppermost sheet in the sheet feeding direction;

the wall portion comprising a sheet receiving surface in contact with each leading edge of the sheets, and a slanted surface positioned downstream of the sheet receiving surface in the sheet feeding direction, the slanted surface being angled with respect to the sheet receiving surface in a direction toward the sheet feeding direction defined by an orientation of the sheets in the hopper;

a stop member movable between a protruding position protruding out of the slanted surface and a retracted position retracting into the slanted surface, the stop member having a contact surface in contact with the sheet, a maximum angle defined between the contacting surface and the sheet in the hopper being 90 degrees when the stop member is in the protruding position;

a biasing member connected to the stop member for urging the stop member to the protruding position;

a conveyer roller;

a follower roller in nipping relation to the conveyer roller, the conveyer roller and the follower roller being positioned downstream of the slanted surface in the sheet feeding direction for conveying the sheet fed by the at least one sheet feed roller to an intended location;

the at least one sheet feed roller further comprising a collar for pressing the uppermost sheet on the hopper, the uppermost sheet bridging between the conveyer roller and the collar under tension to provide a non-slackened state at a position above the slanted surface; and the stop member being positioned spaced away from the sheet when the stop member is in its protruded position during the non-slackened state of the sheet.

* * * * *